United States Patent [19]

Maijala et al.

[11] 4,428,534

[45] Jan. 31, 1984

[54] METHOD OF IMPROVING THE UTILIZATION OF THE HEAT ENERGY PRODUCED IN A WOOD GRINDING PROCESS

[75] Inventors: Ari A. M. Maijala, Tampere; Matti I. Aario, Pirkkala, both of Finland

[73] Assignee: Oy Tampella AB, Tampere, Finland

[21] Appl. No.: 317,642

[22] Filed: Nov. 2, 1981

[30] Foreign Application Priority Data

Nov. 18, 1980 [FI] Finland ..... 803599

[51] Int. Cl.[3] ..... B02C 11/08; B02C 23/24

[52] U.S. Cl. ..... 241/18; 241/21; 241/23; 241/28; 241/65

[58] Field of Search ..... 241/18, 21, 23, 24, 241/28, 30, 33, 60, 65, 282; 162/17, 21, 28, 46, 47, 234, 248

[56] References Cited

U.S. PATENT DOCUMENTS

| | | | |
|---|---|---|---|
| 4,012,279 | 3/1977 | Selander et al. | 241/28 X |
| 4,136,831 | 1/1979 | Cederquist et al. | 241/18 |
| 4,274,600 | 6/1981 | Halkkala | 241/28 X |
| 4,324,612 | 4/1982 | Lindahl | 241/28 |

*Primary Examiner*—Mark Rosenbaum
*Assistant Examiner*—Timothy V. Eley
*Attorney, Agent, or Firm*—Ladas & Parry

[57] ABSTRACT

A method of improving the utilization of the heat energy produced in a wood grinding process when wood is ground in a grinding space (3) under a pressure exceeding atmospheric pressure, and warm shower water (G) is sprayed into the grinding space. Steam (H) is separated from the groundwood pulp (A) discharged from the grinding space in a steam separator wherein the groundwood pulp is allowed to expand from its inlet pressure to atmospheric pressure in at least two steam separators (11,14) by releasing steam from the groundwood pump in each steam separator by decreasing the pulp pressure. The amount of steam (H1,H2) released in the separate steam separators is adjusted according to the proportions in which steam is needed for utilizations purposes. Thus the heat energy of the pressure grinding process can be recovered in separate steam fractions the amount and pressure of which correspond to the requirements of the utilization purposes. It is preferable to heat the shower water by steam of such a volume and pressure that the temperature of the shower water increases to a desired degree, preferably above 100° C.

6 Claims, 2 Drawing Figures

Figure 1:
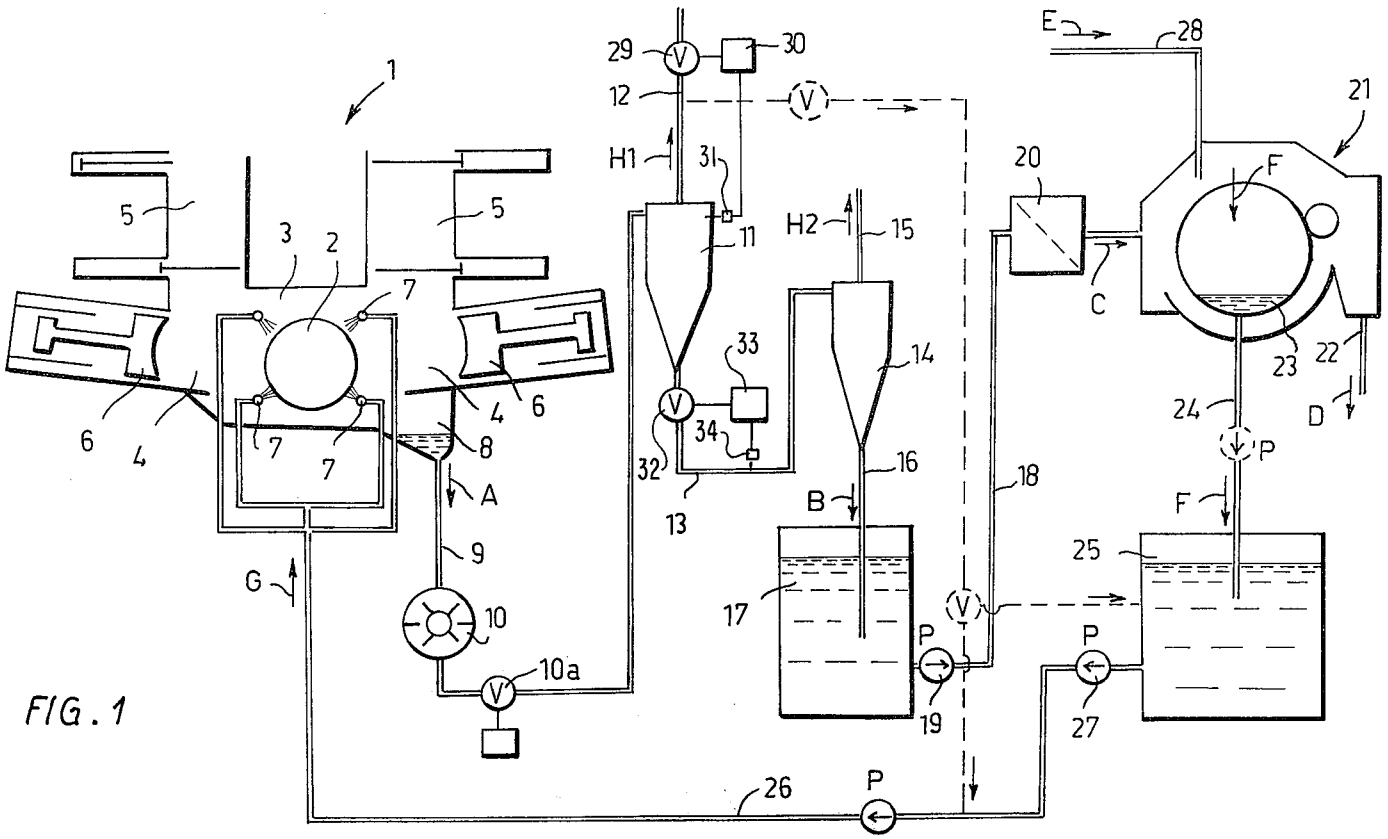

METHOD OF IMPROVING THE UTILIZATION OF THE HEAT ENERGY PRODUCED IN A WOOD GRINDING PROCESS

This invention relates to a method of improving the utilization of the heat energy produced in a wood grinding process. According to this method

- wood is ground by means of a rotating grinding member in a grinding space under superatmospheric pressure,
- warm shower water is sprayed into the grinding space,
- groundwood pulp is fed from the grinding space into a steam separator wherein the heat energy contained in the groundwood pulp is released in the form of steam,
- the groundwood pulp is fed from the steam separator into a thickener in order to remove water from the pulp,
- water removed from the groundwood pulp is returned to the grinding space as shower water,
- water is added to the shower water to compensate losses of shower water,
- steam released in the steam separator is recovered for further use.

Pressurized grinding is known (Finnish patent applications 782414, 780514, 780515, Swedish patent application 7411949-6 and Swedish patent Nos. 318178 and 336952) in which wood is ground in a grinding space under a pressure exceeding atmospheric pressure. Wood is fed into the pressurized grinding space for example by means of pressure equalizing chambers mounted above the grinding pockets of the grinder. The grinding space, defined by gates and a pulp pit, is pressurized preferably with air or steam. The defibration takes place by pressing wood blocks by means of a hydraulic piston against the grinding stone. Vibration caused by the grinding stone, heat caused by friction and shower water sprayed on the grinding stone separate the fibers from the wood material.

It has been observed that in pressurized grinding the temperature of shower water has greater influence on the defibration than under atmospheric pressure. The warmer the shower water is, the longer and more unbroken are the fibers separated from the wood material, and the stronger is the paper made of such fibers. Thus it is the better for the pressurized grinding, the warmer the shower water is when taken back into the grinder.

After defibration the groundwood pulp flows out from the grinding space through a pipe in which sticks and bigger slabs of wood are cut into pieces by a stick crusher before adjusting the flow rate. The temperature of the pulp discharged from the grinding space is normally more than 100° C. In practice the pulp temperature may rise up to 145° C., which depends on the temperature of the shower water and on the pressure of the grinding space. Thereby the temperature of the shower water when fed into the grinding space must be 130°–135° C. and the pressure 3 bar. Heat energy contained in the pulp suspension is released in the form of steam in a steam separator within which the pressure is reduced to atmospheric pressure, because the pulp temperature after the steam separator must be below the boiling point of water. From the steam separator the pulp can flow directly into a thickener where the hot shower water is separated from the pulp and is fed back into the grinding space. From the steam separator pulp can also be discharged into a tank from which it can be pumped to different kinds of screening, a pressurized screen and a hydro cleaner, before it enters a thickener where hot shower water is separated from the pulp. From this thickener pulp is discharged with a consistency of 5–33%.

A disadvantage of this known method is that the steam released from the steam separator has only one pressure and temperature, and these are nearly the lowest pressure and temperature in the closed circuit of the system. The hot groundwood pulp enters the steam separator at a temperature of 115°–125° C., but the evaporation takes place at about 100° C. which is the temperature of the pulp discharged from the steam separator. This decreases the utilization value of the released steam. In many cases a part of the released steam could be used for example by raising the pressure level of the steam by means of a heat compressor and exchanging its heat to pure steam e.g. in order to supply the steam into the counterpressure network of a paper mill. The remaining part could be used for example for various heating purposes without raising the pressure.

Another disadvantage of the above described system is that the temperature of the shower water sprayed into the grinding space cannot be raised above about 100° C. by the steam evaporating from the groundwood pulp in the known system. The temperature of the pulp discharged from the grinding space rises correspondingly to only about 100°–115° C.

The object of this invention is to accomplish a method through which the above mentioned disadvantages are eliminated and through which the usability and utilization value of the steam released from the pressure grinding process can be improved. This object is achieved by the method according to the invention, being characterized by

- that the groundwood pulp discharged from the grinding space is allowed to expand from its inlet pressure to atmospheric pressure in at least two steam separators by releasing steam from the pulp suspension in each steam separator by lowering the pressure, and
- that the amount of steam released from each steam separator is adjusted corresponding to the needs of utilization.

The invention is based on the idea that only a part of the steam in the groundwood pulp passing from the grinder through a stick crusher to the first steam separator is released in the first steam separator. This is possible if the pressure in the steam separator is so high that the temperature of saturated steam corresponding to this steam pressure is only so much under the temperature of the incoming groundwood pulp that only a part of the total potential steam is released in the steam operator. The steam thus released has a higher temperature and pressure than steam obtained by the known method. This steam can now be utilized for purposes in which its higher temperature and pressure are most useful, for example in connection with a heat compressor plant. Correspondingly, the later evaporation can be divided to take place in several steam separators and released steam of different pressures and temperatures can be wholly or partly used for different purposes.

A simple embodiment of the method comprises two steam separators. The steam released in the first steam separator is used for a purpose in which the high pressure gives the highest possible benefit. From the first steam separator the pulp is brought to a second steam separator in which such a pressure is maintained that the pulp is cooled to a temperature of 100°–105° C. depending on other process steps. The steam of lower pressure and temperature released from the second steam separator is used for purposes where this kind of steam is more suitable.

A possible use for the steam of lower pressure and temperature is heating the shower water sprayed into the grinding space. In one or more of serially coupled steam separators steam is released in such an amount and pressure that the temperature of the shower water rises to a desired temperature when this steam is brought into contact with the shower water. The shower water can be under atmospheric or superatmospheric pressure. If the pressure of the shower water exceeds atmospheric pressure, it can be heated above 100° C.

Figure 2:
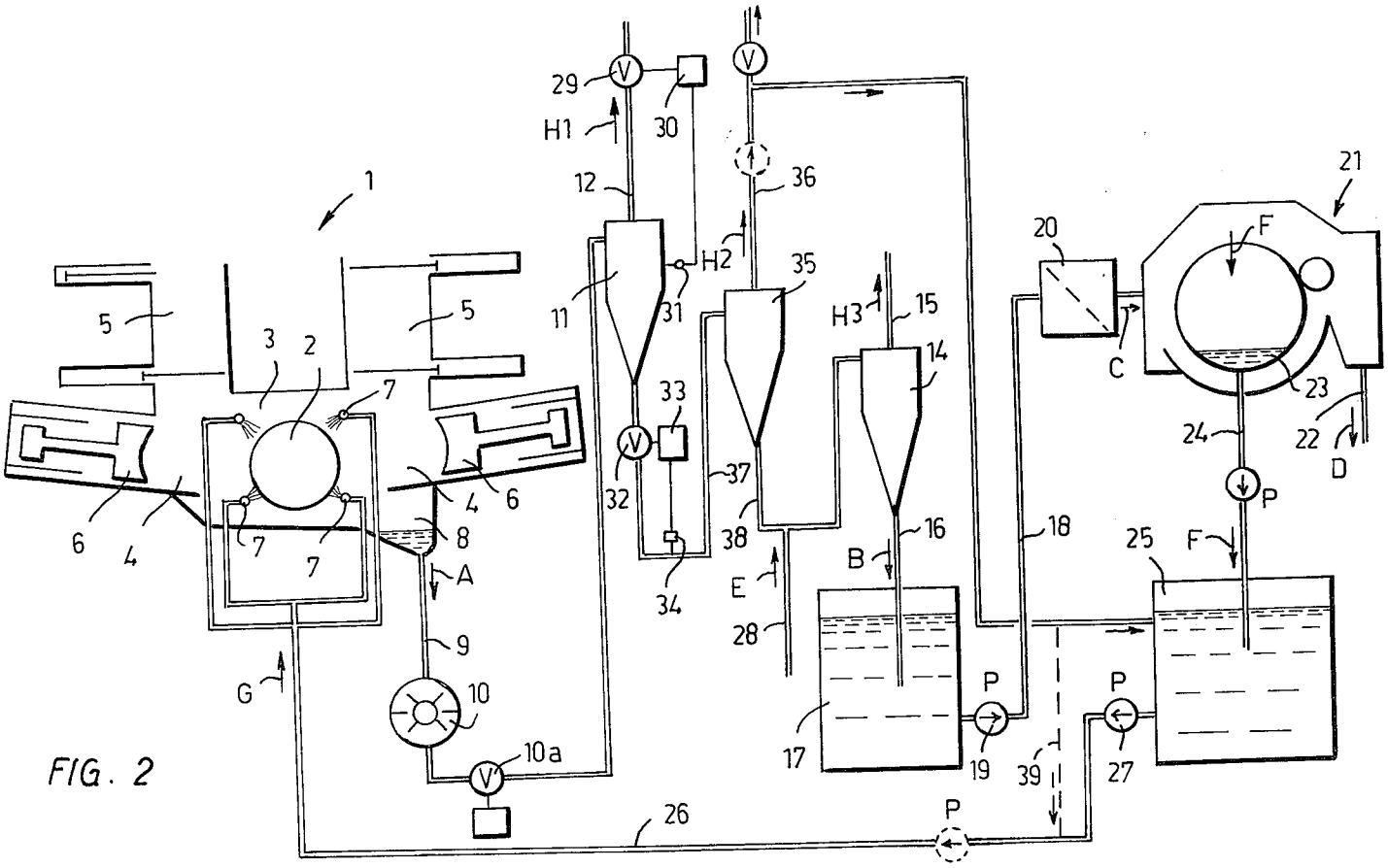

In the following the invention will be described in more detail with reference to the accompanying drawings in which FIG. 1 illustrates schematically a pressure grinding process according to the invention, FIG. 2 illustrates schematically an alternative pressure grinding process.

The drawings illustrate a grinding machine 1 comprising a rotating grinding stone 2 arranged in a pressurized grinding space 3. The grinding space comprises two grinding pockets 4 above which equalizing chambers 5 known per se are provided which are closed by closing gates. On two opposite sides of the grinding stone there are hydraulic pistons 6 for pressing the blocks of wood dropped into the grinding pockets against the grinding stone. In the grinding space there is a number of shower pipes 7 for feeding warm shower water on the grinding stone. For collecting the groundwood pulp there is a pulp pit 8 in the grinding space.

From the pulp pit of the grinder a pipe 9 feeds the suspension A through a stick crusher 10 a blow valve 10*a* to a first steam separator 11 which is provided with an outlet pipe 12 for steam H1 released from the pulp. From this steam separator leads a pipe 13 to a second steam separator 14 which is provided with an outlet pipe 15 for steam H2 still to be released from the pulp. The pressure of the steam separator 11 can be adjusted either by a valve, a regulator and a sensor arranged in the pipe 12 or for example by means of the temperature of the heated surface of a condensating heat exchanger. A pipe 16 feeds the groundwood pulp B, which is released of pressure, from the steam separator 14 to a tank 17. Groundwood pulp C to be thickened in the thickener is fed by a pipe 18 from the tank through a pump 19 and a pressure screen 20. The thickener is provided with an outlet 22 for the thickened pulp D. In the thickener there is a vat 23 for water F removed from the thickened pulp C. From the vat 23 leads a pipe 24 to a tank 25. From the tank 24 leads a pipe 26 through a pump 27 to shower pipes 7 in the grinding space in order to feed warm shower water G to said shower pipes.

When groundwood pulp is made shower water circulates continuously through a circulating system formed by the pipes 9-13-16-18-24-26. A part of the shower water is discharged together with the thickened groundwood pulp, and due to other losses of water from the process, exhausting steam etc., more water must be added into the circulating system than the amount which is discharged from the thickener with the pulp. Replacement water E can be fed for example to the tank 25 or the pipe 16, or by a pipe 28 to the thickener 21 as shown in FIG. 1. If a grinding plant has for example four grinders the steam separator can release steam about 3 kg/s at a temperature of 100° C. and under a pressure of 1,013 bar. The temperature of the groundwood pulp suspension discharged from the grinder can be for example 115° C. It is supposed that the pressure of one half of the steam released from the system shall be increased up to 400 kPa by means of a heat compressor and the other half shall be released under atmospheric pressure. The power requirement of the compressor can be calculated according to the known formula:

$$P = \dot{m}\,\frac{p_{ek}\cdot k}{\rho_{ek}\,(k-1)\eta_y}\cdot\left[\left(\frac{p_{ku}}{p_{ek}}\right)^{\frac{k-1}{k}} - 1\right]$$

in which

P=power requirement of the compressor, kW $\dot{m}$=pulp flow, kg/s $P_{ek}$=pressure before the compressor, kPa $P_{ku}$=pressure after the compressor $\rho$=gas thickness before the compressor, kg/m$^3$ k=thermal compressability $\eta_y$=mechanical efficiency of the compressor.

Because the steam must be pure when a compressor is being used, the steam must be replaced by pure steam in the heat exchanger. The economic temperature of pure steam is thereby about 95° C. The power requirement of the compressor is calculated according to the known method, providing that $\dot{m}$=1,5 kg/s $P_{ek}$=84,5 kPa $P_{ku}$=400 kPa $\rho$=0,5045 k=1,3

$\eta_y$=0,8

$$P = 1{,}5\,\frac{84{,}5\cdot 1{,}3}{0{,}5045}\left[\left(\frac{400}{84{,}5}\right)^{\frac{0{,}3}{1{,}3}} - 1\right] = 590\ \text{kW}$$

In the method according to the invention the temperature of the groundwood pulp is allowed to decrease in the first separator 11 to only 107,5° C. by adjusting the pressure of the steam released in the steam separator. Thus the temperature of the steam H1 leaving the steam separator is about 107,5° C. In the heat exchanger the steam temperature decreases further 5° C. so that the temperature of the steam to be compressed is about 102,5° C., the pressure is 110,7 kPa and the density is 0,6495 kg/m$^3$.

The power requirement of the heat compressor is now $$P = 1{,}5\,\frac{110{,}7\cdot 1{,}3}{0{,}6495\cdot 0{,}3\cdot 0{,}8}\left[\left(\frac{400}{110{,}7}\right)^{\frac{0{,}3}{1{,}3}} - 1\right] = 478\ \text{kW}$$

The saving in the power requirement of the compressor is 112 kW which is about 19%.

The volume flow of the steam to be compressed decreases correspondingly about 20%. Therefore also the requirement equipment is of a smaller size and this decreases the cost of investment.

The steam pressure in the pressurized steam separator is adjusted by a valve 29 which is controlled by a controller 30 according to the measures of a pressure sensor 31. The groundwood pulp level in the pipe following the steam separator is regulated by a valve 32 which is controlled by a controller 33 according to the measures of a sensor 34 for the pulp level.

It is evident that due to the method according to the invention the heat energy of the pressure grinding process can be recovered as shown in FIG. 1 both as steam H1 of higher temperature and pressure, and as steam H2 of atmospheric pressure and lower temperature. By regulating the pressure of the first steam separator the amount of steam H1 and steam H2 can be mutually controlled to correspond to the requirements of the uses of such steam.

FIG. 2 illustrates an alternative embodiment of the method according to the invention. In this embodiment the steam released from the groundwood pulp is used for heating the shower water to be sprayed into the grinding space of the grinder.

The equipment and arrangements of the alternative embodiment illustrated in FIG. 2 correspond substantially to the embodiment of FIG. 1 except that in the embodiment of FIG. 2 a steam separator 35 is provided between the pressurized steam separator 11 and the atmospheric steam separator 14 so that the groundwood pulp discharged from the grinding space expands from the inlet pressure to atmospheric pressure in three phases. From said steam separator 35 leads an outlet pipe 36 for feeding the steam which is released in the steam separator, to the tank 25 for heating the shower water 1. The steam separator 35 is connected to the first steam separator by a pipe 37 and to the third steam separator by a pipe 38. The pipe 28 bringing replacement water E is connected to the inlet pipe 38 of of the third steam separator 14.

The two first steam separators in the system according to FIG. 2 are pressurized and the last one is at atmospheric pressure. In principle the whole system could work also below atmospheric pressure. In such a case the steam from the different steam separators would be supplied to condensers arranged in series, for example traditional recuperative heat exchangers or water towers in which the steam is in direct contact with the liquid to be condensed.

In the known system the shower water temperature is about 99° C. It is supposed that the amount of groundwood pulp discharged from the grinder is 80 kg/s and the temperature 115° C. Before the steam separator the temperature of the incoming water is 60° C. and volume 8 kg/s. Thus the temperature of the groundwood pulp entering the steam separator is $$\frac{80 \cdot 115^\circ\text{ C.} + 8 \cdot 60^\circ\text{ C.}}{88} = 110^\circ\text{ C.}$$

The volume of the evaporating steam is 1,63 kg/s and the transferred heat energy is 3,7 MW. The steam temperature is about 100° C. and the pressure about 100 kPa.

In the system according to the invention the temperature of the shower water is supposed to be 115° C. and the volume flow of groundwood pulp discharged from the grinder is about 80 kg/s and temperature 130° C. The pressure decreases in the first steam separator 11 to a pressure of 239 kPa of saturated steam, corresponding to a temperature of 126° C. In the second steam separator 29 the temperature decrease is from 126° C. to 111° C. and the pressure is about 148 kPa. Before the third steam separator 14 the system receives a water addition of 8 kg/s and 60° C. In the third steam separator the pulp temperature decreases from 106,1° C. to about 100° C.

Steam is generated and heat energy is transferred in the different steam separators as follows:

| | | |
|---|---|---|
| 1. steam separator | 0,60 kg/s | 1,34 MW |
| 2. steam separator | 2,21 kg/s | 5,00 MW |
| 3, steam separator | 0,98 kg/s | 2,21 MW |

The steam released from the various steam separators can be used for example as follows:

1. steam separator

The steam H1 is brought to a heat exchanger equipment in which this impure steam is condensed by evaporating on the secondary side of the exchanger pure steam up to 121° C. and 205 kPa. According to the above-mentioned formula for the energy requirement of the compressor it can be calculated how much the compression of this steam to 400 kPa requires electric energy.

$$P = 0{,}60 \frac{205 \cdot 1{,}3}{1{,}155 \cdot 0{,}3 \cdot 0{,}8} \left[ \left( \frac{400}{205} \right)^{\frac{0{,}3}{1{,}3}} - 1 \right] = 96\text{ kW.}$$

2. steam separator

The steam H2 is brought into direct contact with pressurized shower water either in the tank 25 as shown in FIG. 2, in a shower water tower or in a sheet condenser or similar. Thereby the steam is condensed at about 110° C. Because the steam amount corresponds to a change of 15° C. in a liquid flow of 80 kg/s, also the shower water temperature increases 15° C. from 100° C. to 115° C.

3. steam separator

The steam H3 released from the steam separator can be used for example to heat water for district heating. Such a use of the steam requires compressor energy:

$$P = 0{,}60 \frac{100 \cdot 1{,}3}{0{,}5977 \cdot 0{,}3 \cdot 0{,}8} \left[ \left( \frac{400}{100} \right)^{\frac{0{,}3}{1{,}3}} - 1 \right] = 204\text{ kW.}$$

By means of the method according to the invention it is possible to obtain about 38% of the total steam energy as compressed steam of 400 kPa by using less than half of the compressor energy. At the same time the compressor size and thereby also investment costs are substantially decreased.

The system gives also a possibility to regulate the shower water temperature within very broad limits by only changing the steam separator in which the shower water is heated.

When the steam released from the steam separator is used for heating shower water, the steam H2 from the second steam separator 35 can be fed by a pipe 39 also directly to the shower water G for heating the same, as indicated by dotted lines in FIG. 2. Alternatively it is possible to heat the shower water wholly or partly with the steam H1 of the steam separator 11, which steam is brought into the tank 25 or directly into the shower water as shown in FIG. 1 through the pipe 39 indicated by dotted lines.

The steam H2, FIG. 1, or H3, FIG. 2, of a lower pressure is wholly or partly recovered. The steam separator 14 and the tank 17 may be combined to form only one vat.

What we claim are:

1. A method of improving the utilization of the heat energy produced in a wood grinding process of the type in which wood is ground by means of a rotating grinding member in a grinding space under superatmospheric pressure while warm shower water is sprayed into the grinding space, and the groundwood pulp is fed from the grinding space into steam separator means wherein the heat energy contained in the groundwood pulp is released in the form of steam, which method is characterized by the fact the groundwood pulp discharged from the pressurized grinding space is allowed to expand from its inlet pressure to atmospheric pressure in at least two steam separators by releasing steam from the pulp suspension in each steam separator by lowering the pressure therein, and that the temperature and pressure of the steam released from each steam separator is adjusted to correspond to steam utilization needs, the groundwood pulp being allowed to expand in the steam separators to such an extent that the pulp suspension temperature is decreased in the last steam separator to about 100° C.

2. A method according to claim 1, in which pressurized steam released in the steam separators is used for heating the shower water to be fed into the grinding space.

3. A method according to claim 2, in which released steam of a pressure above atmospheric pressure is used to heat the shower water to a temperature preferably exceeding 100° C.

4. A method according to claim 2, in which released steam of atmospheric pressure is used to heat the shower water.

5. A method according to claim 2, in which the steam is fed directly into the shower water.

6. A method according to claim 1, in which the groundwood pulp is allowed to expand in at least three steam separators, and steam for heating the shower water is released at the earliest from the second steam separator.

* * * * *